US011753895B2

(12) United States Patent
Orbell et al.

(10) Patent No.: US 11,753,895 B2
(45) Date of Patent: Sep. 12, 2023

(54) MULTIPURPOSE LATCH FOR JACK-UP RIG

(71) Applicant: ADS Services, LLC, Midland, TX (US)

(72) Inventors: Charles Orbell, Satellite Beach, FL (US); Christian Leuchtenberg, Singapore (SG); Sean Austin Alley, Wolfforth, TX (US)

(73) Assignee: ADS Services, LLC, Midland, TX (US)

( * ) Notice: Subject to any disclaimer, the term of this patent is extended or adjusted under 35 U.S.C. 154(b) by 0 days.

(21) Appl. No.: 17/726,162

(22) Filed: Apr. 21, 2022

(65) Prior Publication Data

US 2022/0341276 A1 Oct. 27, 2022

Related U.S. Application Data

(60) Provisional application No. 63/177,961, filed on Apr. 22, 2021.

(51) Int. Cl.
*E21B 33/038* (2006.01)
*E21B 33/076* (2006.01)
*E21B 33/035* (2006.01)

(52) U.S. Cl.
CPC ..... *E21B 33/038* (2013.01); *E21B 33/076* (2013.01); *E21B 33/0353* (2020.05)

(58) Field of Classification Search
CPC ... E21B 33/038; E21B 33/076; E21B 33/0353
See application file for complete search history.

(56) References Cited

U.S. PATENT DOCUMENTS

| | | | | |
|---|---|---|---|---|
| 4,688,633 | A * | 8/1987 | Barkley | E21B 33/038 166/341 |
| 5,309,991 | A * | 5/1994 | Watkins | E21B 33/038 285/309 |
| 7,717,170 | B2 | 5/2010 | Williams | |
| 2011/0036589 | A1* | 2/2011 | Rodgers | E21B 33/038 166/360 |
| 2015/0083430 | A1* | 3/2015 | Jahnke | F16L 37/62 166/338 |
| 2017/0328165 | A1 | 11/2017 | Rao et al. | |
| 2018/0010411 | A1* | 1/2018 | Kroesen | E21B 33/063 |
| 2020/0362659 | A1* | 11/2020 | Fraczek | E21B 33/068 |
| 2021/0189828 | A1* | 6/2021 | Dietrich | E21B 17/085 |
| 2022/0186570 | A1* | 6/2022 | De Mello | F16L 37/098 |

OTHER PUBLICATIONS

Patent Cooperation Treaty: International Search Report and Written Opinion for PCT/US22/25980 (related application); Kari Rodriguez; Aug. 1, 2022; 10 pages.

* cited by examiner

*Primary Examiner* — James G Sayre

(57) ABSTRACT

A multipurpose latch assembly (MPLA) for installation above the bore of a blowout preventer includes an annular sidewall extending between a top flange and a bottom flange and having an interior bore surface defining an interior bore. A plurality of latching slots extend through the sidewall and a latching dog is slidably positioned in each latching slot. Actuators are connected to the latching dogs to extend and retract them through the latching slots. A tool having an external slot can be inserted into the bore of the MPLA and selectively engaged by the latching dogs to secure the tool in the bore of above the blowout preventer.

20 Claims, 8 Drawing Sheets

MULTIPURPOSE LATCH FOR JACK-UP RIG

CROSS-REFERENCE TO RELATED APPLICATIONS

This application claims benefit of U.S. Provisional Application No. 63/177,961, filed Apr. 22, 2021, entitled MULTIPURPOSE LATCH FOR JACK-UP RIG, the specification of which is incorporated by reference herein in its entirety.

FIELD OF INVENTION

This invention relates in general to fluid drilling and intervention equipment and in particular to jack-up drilling rigs. More specifically, embodiments of the present disclosure relate to a latch that can be inserted into the riser located between the blow out preventer (BOP) and the drill floor of a jack-up drilling rig or a large land drilling rig.

BACKGROUND OF INVENTION

In the drive for greater efficiency, drilling rig owners and operators leasing drilling rigs are looking for less dependency on proprietary systems where these are part of the normal drilling rig stack-up. The jack-up rig is a multipurpose tool being used for exploration drilling, completion drilling, intervention and workovers. At different stages some of these operations require pressurized interventions like: logging under pressure, snubbing (tubing workovers under pressure), managed pressure drilling, mud-cap drilling and sometimes temporary, unplanned operations under pressure.

Prior art solutions were very tool specific, e.g., for logging adapters U.S. Pat. No. 4,836,289 to Young and U.S. Pat. No. 9,057,239 to Young, and for rotating control devices U.S. Pat. No. 7,717,170 to Williams and U.S. Pat. No. 9,988,871 to Gray. Today there is a drive towards standardization for these pressurized operations, much the same as there was successful standardization of drilling BOP systems in the sense that while the internals of the BOP systems may be different, the connections sizes and ratings are standard being typically 18¾ inches bore and pressure ratings of 5 k psi and 10 k psi. There are a few higher pressure rated 15 k psi BOP systems, but they are not the norm.

What is required for enabling cost efficiency and some standardization for rig owners and the leasing operators is to have the key equipment that requires interfacing as part of the rig systems. The oil field service companies like to lease their proprietary equipment and for offshore floating drilling units there has been some capital sales of equipment for pressurized drilling. This concept has not really taken off in the more price sensitive jack-up rig market. The result is that pressurized operations always require some sort of proprietary interface which costs time and money to prepare and may change as the leasing operator has different service company and tool preferences.

The area under discussion is the connection from the top of the annular BOP, which is at the top of the main ram BOPs, to the mud overflow just below the drill floor going to the mud return line. Typically, the top of the annular BOP is an 18¾ inch API flange rated at 5,000 or 10,000 psi. From here a 20 inch lower pressure bore system is installed. There are variations of this final rig-up portion from the top of the annular BOP depending on whether the rig has just a bell nipple or a diverter as part of the system. The exact design above is of no consequence to this invention as the purpose of this invention is to have a standard latch system just above the annular BOP which has at the bottom an 18¾ inch bore interface and at the top a 20 inch nominal bore interface.

The embodiments of the invention shown will enable the drilling rig to have standard systems in place for a variety of pressurized operations that are independent of the service providers. By the drilling rig owner installing this as standard equipment much as the drilling BOP is standard, they will enable the drilling rig to be capable of converting to pressurized operations as required in the minimum of time at a much reduced cost.

The current state of the art for snubbing, coiled tubing or logging adapters is to deploy a tubular with a expansion at the end like a flange or an upset, then clamping it with the annular BOP which is serving a dual purpose in that is seals on the tubular for pressure isolation and the upset or flange prevents ejection of the adapter under pressure from the wellbore below the annular BOP. This is not a safe practice; firstly as it is not really the design intent of the annular BOP and secondly because it removes the functionality of the annular BOP (emergency closure for a pressure event) when a pressurized operation is intended. The disclosed invention makes it easy to have the correct adapter for logging, snubbing or coiled tubing operations under pressure.

An example is the typical situation today for installing a rotating control device (RCD) in the riser above the annular BOP. Specifically, for jack-up drilling rigs or land drilling rigs the RCD body or housing is typically installed just above the annular BOP situated on top of the main BOP. This involves removing the riser that is bolted to the top of the annular BOP, installing the RCD housing by bolting the bottom flange of this housing to the annular BOP and then re-installing the riser pipe on top of the RCD housing by bolting to the top flange of the RCD housing. As the riser pipe now is too long by the length of RCD housing attached, it usually requires a custom riser pipe to be built before this RCD installation or to cut the existing riser pipe to shorten it, and rewelding it. Later after removing the RCD housing this shortened riser pipe will need to be reinstated to the origin length or a new riser pipe built to the same dimensions as the original one. This is a very inefficient method.

A need therefore exists, for a multipurpose latch assembly that can address the previously described complexity and enable a fixed, permanent, cost effective installation that can be used by different service companies. So instead of the drilling rig having to adapt to the service provider design, the service provider can adapt their equipment interface to the drilling rig installed system. This would remove the need for custom modifications which in many cases hold up pressurized operations or even completely cancel them due to the time and complexity required to modify the drilling rig.

A need further exists, for a multipurpose latch assembly that can enable the drilling rig to be ready at all times for a variety of pressurized operations with much improved safety and cost effectiveness.

SUMMARY

A multipurpose latch assembly is provided for the riser system of a jack-up drilling rig or a land drilling rig enabling pressurized operations like logging under pressure, snubbing, managed pressure drilling, mud-cap drilling and emergency retrieval of drilling tools under pressure. The latch can be used to rapidly install and de-install RCD bearings between the BOP and the drill floor. It uses independent pistons working on a common external diameter and latch profile diameter to enable the same system to be used for variations in bore and pressure ratings.

The multipurpose latch assembly as described herein can address the complexity of prior art systems and enable a fixed, permanent, cost effective installation that can be used by different service companies. So instead of the drilling rig having to adapt to the service provider design, the service provider adapts their equipment interface to the drilling rig installed system. This removes the need for custom modifications which in many cases hold up pressurized operations or even completely cancel them due to the time and complexity required to modify the drilling rig.

The multipurpose latch assembly as described herein can enable the drilling rig to be ready at all times for a variety of pressurized operations with much improved safety and cost effectiveness.

According to a first embodiment, a latching system assembly is disclosed that enables a pressure seal between the latch assembly and the annular BOP for securing a snubbing or coiled tubing adapter.

According to a second embodiment, a latching system assembly is disclosed that enables a pressure seal between the latch assembly and the annular BOP for securing a logging adapter.

According to a third embodiment, a latching system assembly is disclosed that enables a pressure seal between the latch assembly and the annular BOP for an RCD bearing assembly for drilling under pressure or as a safety system in case of unplanned pressure.

According to a fourth embodiment, a latching system assembly is disclosed that enables a pressure seal between the latch assembly and the annular BOP for installing any tool that may be required at such a location.

According to a fifth embodiment, an isolation sleeve is disclosed for the latching system assembly that has seals placed at the upper and lower vertical extremities of the isolation sleeve.

According to a sixth embodiment, seals are disclosed on the tools comprising the snubbing, logging, coiled tubing or bearing adapters, wherein the seals on the tools are placed in a different position compared to the seals on an isolation sleeve for the purposes of providing a pristine sealing surface in the seal bore after long period of using the isolation sleeve.

In another aspect, a multipurpose latch assembly (MPLA) is provided for a drilling rig having a blow out preventer (BOP), wherein the BOP includes a housing defining a vertical bore extending through the housing along a vertical axis, the vertical bore having a BOP bore diameter. The MPLA comprises a body including an upper flange having an upper flange configuration, a lower flange having a lower flange configuration, and an annular sidewall extending between the upper flange and the lower flange about the vertical axis. An inner surface of the sidewall defines a receiving bore formed about the vertical axis, the receiving bore having a receiving bore diameter. In some embodiments, the receiving bore diameter of the MPLA is greater than the BOP bore diameter. The sidewall further defines a plurality of latching slots extending radially outward, relative to the vertical axis, from the receiving bore. A plurality of actuator assemblies are attached to an outer surface of the sidewall, each respective actuator assembly being disposed adjacent a respective latching slot. Each actuator assembly includes a cylinder having a cylinder bore, a piston slidably mounted in the cylinder bore to define a latch cavity disposed on a first side of the piston, and an unlatch cavity disposed on a second side of the piston. Selectively adding fluid into the latch cavity causes the piston to move in a first direction and selectively adding fluid into the unlatch cavity causes the piston to move in a second direction. Each actuator assembly further comprise a plurality of latching dogs, each respective latching dog being slidably mounted in a respective latching slot for moving between an unlatched position, wherein a radially inner end of the respective latching dog is disposed within the respective latching slot and does not extend radially inward into the receiving bore, and a latched position, wherein the radially inner end of the respective latching dog extends radially inward at least partially into the receiving bore. Each respective latching dog is operatively mechanically connected to a respective piston so that moving the respective piston in the first direction causes the respective latching dog to move toward the latched position and moving the respective piston in the second direction causes the respective latching dog to move toward the unlatched position. The MPLA is adapted to receive, in the receiving bore, a tool having a circumferential sidewall with a circumferential inset slot formed in a radially outer surface thereof, the circumferential sidewall having a tool body diameter and the circumferential inset slot having a slot depth below the radially outer surface of the circumferential sidewall. In some embodiments, the tool body diameter is greater that the BOP bore diameter. The receiving bore diameter of the MPLA is selected so that, when the latching dogs are in the unlatched position, the tool is insertable into the receiving bore of the MPLA such that the circumferential inset slot of the tool is axially aligned with the latching slots of the MPLA, and when the latching dogs are in the latched position, the tool is not insertable into the receiving bore of the MPLA such that the circumferential inset slot is axially aligned with the latching slots. When the tool is inserted into the receiving bore of the MPLA such that the circumferential inset slot of the tool is axially aligned with the latching slots of the MPLA and the latching dogs are in the latched position, the inner ends of the latching dogs extend into the circumferential inset slot to prevent withdrawal of the tool body from the receiving bore.

In one embodiment, the receiving bore diameter of the MPLA is greater than the BOP bore diameter and the MPLA is adapted to receive, in the receiving bore, a tool having a tool body diameter that is greater that the BOP bore diameter.

In another embodiment, the radially inner end of the latching dogs are shaped concavely with the same radius as the inner surface of the sidewall defining the receiving bore. When the latching dogs are fully retracted, the radially inner faces of the latching dogs are flush with the sidewall bore.

In one embodiment, each actuator assembly further comprises a piston shaft extending from the piston to the latching dog through a radially inner wall of the cylinder to operatively mechanically connect the piston the latching dog.

In another embodiment, each actuator assembly further comprises an indication pin extending from the piston through a radially outer wall of the cylinder to an exterior of the MPLA to provide an external visual indication of the position of the piston and the attached latching dog.

In yet another embodiment, the MPLA is adapted to receive a tool in the receiving bore, wherein the tool is an adapter for a snubbing tool, and wherein the tool has a first seal between the tool and the receiving bore disposed at a first axial position along the vertical axis and a second seal between the tool and the receiving bore disposed at a second axial position along the vertical axis.

In still another embodiment, the MPLA is adapted to receive a tool in the receiving bore, wherein the tool is a coil tubing adapter, and wherein the tool has a first seal between the tool and the receiving bore disposed at a first axial position along the vertical axis and a second seal between the tool and the receiving bore disposed at a second axial position along the vertical axis.

In a further embodiment, the MPLA is adapted to receive a tool in the receiving bore, wherein the tool is a logging adapter, and wherein the tool has a first seal between the tool and the receiving bore disposed at a first axial position along the vertical axis and a second seal between the tool and the receiving bore disposed at a second axial position along the vertical axis.

In a yet further embodiment, the MPLA is adapted to receive a tool in the receiving bore, wherein the tool is an adapter for a rotating control device (RCD) bearing assembly, and wherein the tool has a first seal between the tool and the receiving bore disposed at a first axial position along the vertical axis and a second seal between the tool and the receiving bore disposed at a second axial position along the vertical axis.

In another embodiment, the MPLA is adapted to receive an isolation sleeve in the receiving bore when a tool is not present in the receiving bore. The tool that is not present in the receiving bore has a first tool seal between the tool and the receiving bore disposed at a first axial position along the vertical axis and a second tool seal between the tool and the receiving bore disposed at a second axial position. The isolation sleeve has a first sleeve seal between the isolation sleeve and the receiving bore disposed at a third axial position along the vertical axis, the third axial position being different from both the first and second axial positions, and a second sleeve seal between the isolation sleeve and the receiving bore disposed at a fourth axial position along the vertical axis, the fourth axial position being different from both the first and second axial positions.

In yet another embodiment, the isolation sleeve that the receiving bore is adapted to receive has an inner bore that is equal in diameter to the bore of the BOP below.

In still another embodiment, the isolation sleeve that the receiving bore is adapted to receive has vertical O-ring positions in different vertical locations from the O-ring position of the tool that is not present in the receiving bore.

In a still further embodiment, the MPLA is further adapted to receive an isolation sleeve in the receiving bore when the tool is not present, the isolation sleeve having a first seal between the isolation sleeve and the receiving bore disposed at a third axial position along the vertical axis, the third axial position being different from both the first and second axial positions, and a second seal between the isolation sleeve and the receiving bore disposed at a fourth axial position along the vertical axis, the fourth axial position being different from both the first and second axial positions.

In another embodiment, the inner surface of the annular sidewall further defines a mounting shoulder disposed at a lower end of the receiving bore, the mounting shoulder comprising at least one shoulder profile having a shoulder diameter that is less than the receiving bore diameter, the shoulder profile having an axial position, relative to the latching slots, to stop insertion of the tool into the receiving bore when the circumferential inset slot of the tool is axially aligned with the latching slots of the MPLA.

In yet another embodiment, the actuators are hydraulic acutators.

In yet another embodiment, the actuators are electric acutators.

In still another embodiment, the upper flange configuration is one of a 20¾ inch 3000 psi flange according to API 6A, or a 21¼ inch×2000 psi flange according to API 6A.

In a further embodiment, the lower flange configuration is a 21¼ inch×5000 psi flange according to API 6A.

In a still further embodiment, the upper flange configuration is a 20¾×5000 psi flange according to API 6A.

In yet another embodiment, the MPLA further comprises an adapter spool for attachment between the MPLA body and the BOP. The adapter spool comprises an upper spool flange having an upper spool flange configuration adapted for attachment to the lower flange of the MPLA, a lower spool flange having a lower spool flange configuration adapted for attachment to an upper flange of the BOP, and an annular spool sidewall extending between the upper spool flange and the lower spool flange about the vertical axis. The length of the annular spool sidewall is selected to provide a desired overall MPLA length, measured between the upper flange of the MPLA body and the lower spool flange of the adapter spool, equal to a length of a pre-existing riser component to be removed for installation of the selected tool.

In a further embodiment, the upper spool flange configuration is a 21¼ inch×5000 psi flange according to API 6A.

In a still further embodiment, the lower flange configuration is a 18¾ inch×5000 psi flange according to API 6A.

In a yet further embodiment, the annular spool sidewall further comprises one or more inlets formed through the spool sidewall or one or more outlet holes formed through the spool sidewall

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTIONS

Figure 1:
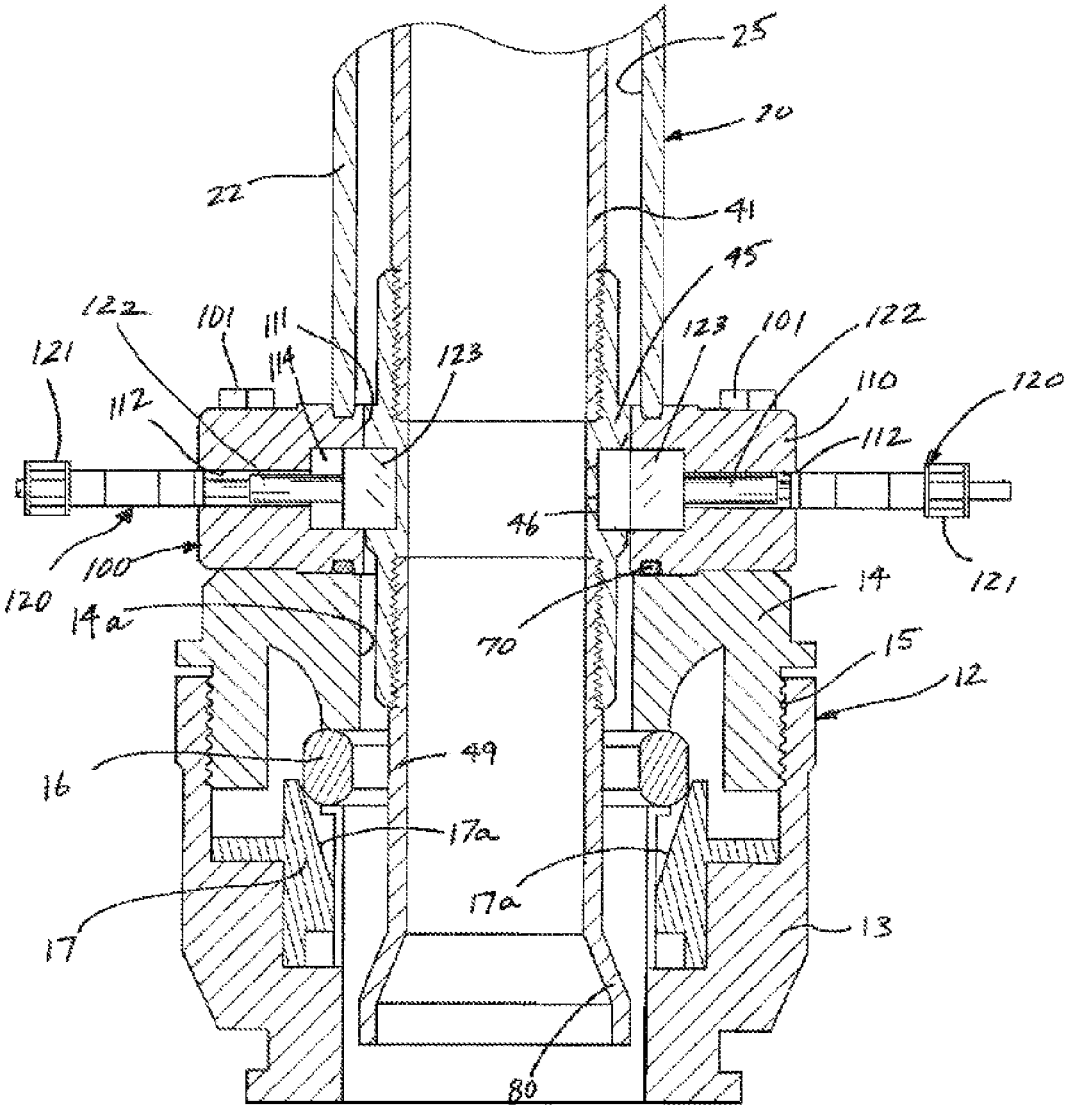
Fig. 1 (Prior Art)
FIG. 1 is a cross section view of a prior art lockdown apparatus for securing a lubricator assembly to be used for wireline operations.
Figure 2:
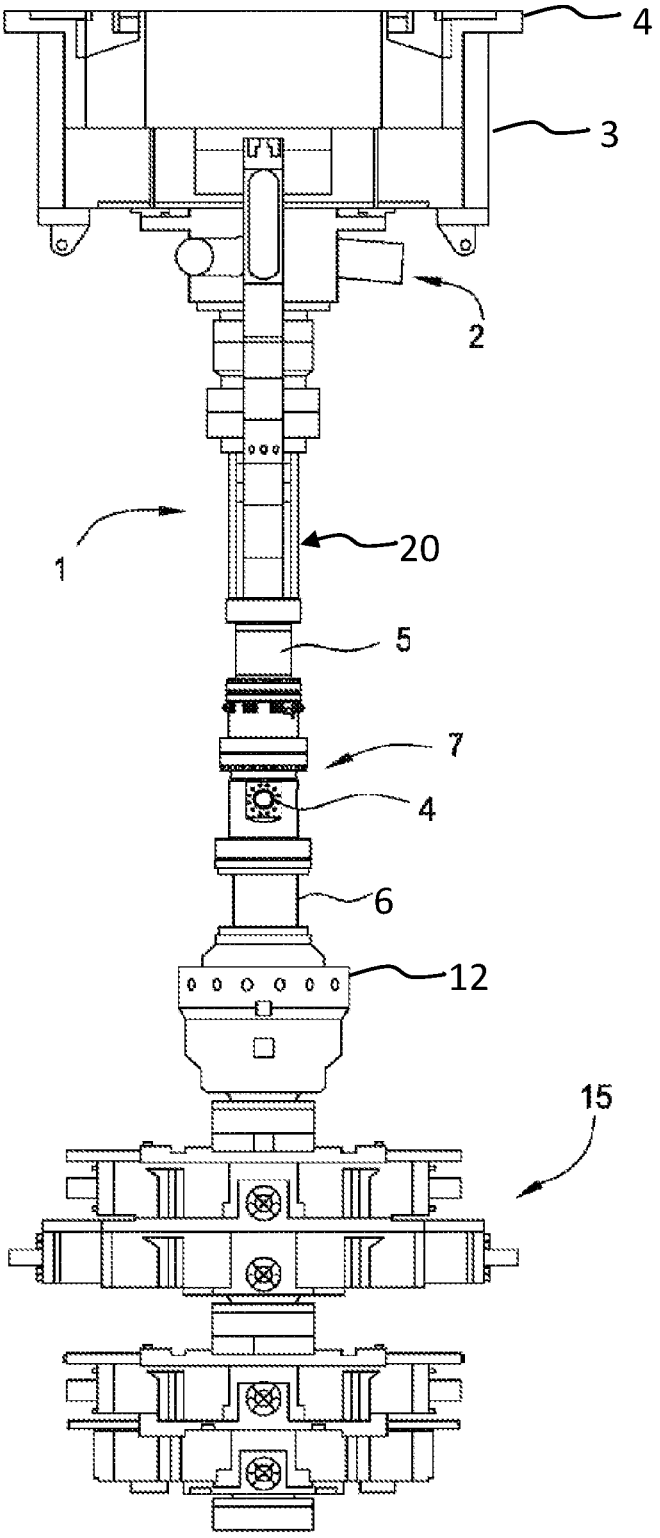
Fig. 2 (Prior Art)
FIG. 2 is a side view of a prior art rotating control device installation on a typical drilling riser above the BOP on a jack-up drilling rig.

The problems being solved and the solutions provided by the embodiments of the principles of the present inventions are best understood by referring to FIGS. 1 to 7 of the drawings, in which like numbers designate like parts. FIGS. 1 and 2 refer to prior art solutions that are incorporated for reference.

FIG. 1 (Prior Art) depicts a side sectional view of locking assembly 100 of a prior art apparatus installed on a well and, more particularly, the upper surface of a blowout preventer assembly. Annular blowout preventer assembly 12 comprises lower body member 13 and upper body member 14 joined at threaded connection 15. Supported within said annular blow-out preventer assembly 12 is an annular seal member 16. Carried within an annular cavity of the body is an annular piston 17 having inclined surface 17*a* which is mounted for reciprocal movement therein under the influence of hydraulic pressure. The precise details of operation of an annular blowout preventer such as annular preventer assembly 12 is well known to those having skill in the art and is for illustration only. Locking assembly 100 in this case consists of a flange like body 110 bolted with bolts 101 directly to the top of the annular. Extending upwardly from said locking assembly 100 is bell nipple assembly 20 comprising tubular body member 22 having a central bore defining internal surface 25. As depicted in FIG. 1, said tubular body member 22 of bell nipple assembly 20 is permanently joined with body member 110 of locking assembly 100. Seal ring 70 is provided to assure a fluid-tight seal between said body member 110 of locking assembly 100 and annular preventer assembly 12. Tubular body member 41 of lubricator assembly 40 is disposed within tubular body member of 22 of bell nipple assembly 22. Flange-like body member 110 also has a plurality of transverse radial bores 112. In the preferred embodiment, said radial bores are oriented substantially perpendicular to central through-bore 111, and extend from the outer surface of said flange-like body member 110 to central through-bore 111. Said radial bores 112 are larger near said central through-bore 111, thereby defining enlarged recess areas 114. Locking pin members 122 can engage with the lubricator central mandrel member 45. The lower tubular member 49 of the wireline lubricator assembly has an enlarged centralized portion 80 that sits below the annular BOP 12 sealing system. A locking pin drive assembly 120 is disposed within each of said bores 112. Said locking pin drive assemblies 120 each comprise an automated drive motor 121 connected to a drive pin 122. Said automated drive motors 121 each comprise linear actuators that, when actuated, selectively motivate locking pins 122 axially within transverse radial bores 112. A locking block 123 is disposed at the distal end of each of said drive pins Lubricator central mandrel member 45 has lower circumferential ledge member 46.

This prior art system shown in FIG. 1 does not show or have a seal between the lubricator central mandrel 45 and the bore 25. Commonly in such systems the annular preventer is closed on the lower tubular member 49 to provide a seal when required. Such a practice is also common for snubbing operations where typically an integral pipe high pressure pipe is used with a flange at the bottom replacing the item 80. It will be shown that the new invention also provides a sealing system that enables professional isolation of the bore below the latching system. The practice shown in FIG. 1 is not safe as it prevents the use of the annular BOP 12 in case of any equipment failure above.

FIG. 2 depicts a typical prior art riser installation for an offshore jack-up drilling rig. We have a rig floor 4 with a substructure 3. Like assemblies with FIG. 1 are numbered the same. The view is illustrating a rotating control device 7 coupled to a riser assembly 1. As illustrated, the rotating control device 7 is connected to a Blow Out Preventer (BOP) stack 15 via a first riser portion 6 connected to an annular BOP 12. The BOP stack 15 is typically used to ensure pressure control in the riser system 1. The rotating control device 7 is also connected to a bell nipple assembly 20 via a second riser portion 5. The usual bell nipple outlet 2 goes to atmosphere. This arrangement may be used in a managed pressure drilling (MPD) operation. Generally, MPD is a form of well control, which uses a closed, pressurized fluid system that allows greater, and more precise control of a wellbore pressure profile than mud weight and mud pump rate adjustments alone. Some examples of MPD are constant bottom hole pressure drilling, dual gradient drilling and pressurized mud cap drilling. During the MPD operation, drilling fluid (mud) is pumped down a drill string located in the riser and the return fluid is communicated from the riser to a drilling fluid receiving device. The return fluid is communicated from the riser via an outlet 8 in the rotating control device 7 and suitable conduits attached thereto when a bearing assembly with one or more seals is disposed in the rotating control device 7. If the bearing assembly has been removed from the rotating control device 7, then the return fluid is communicated from the riser via the diverter or bell nipple outlet 2. In this particular case the rotating control device is a proprietary unit. To install rotating control device, the bell nipple assembly 20 would have to be shortened and the second riser portion 5 which is actually a cross-over as well as the first riser portion 6 which is another cross-over would have to be fabricated.

The new invention disclosed below and in FIGS. 3 to 7 shows how a single permanent multipurpose latch assembly enables the drilling rig to convert easily for a variety of pressurized operations without having to always modify the drilling rig bell nipple assembly for each proprietary installation.

Figure 3A:
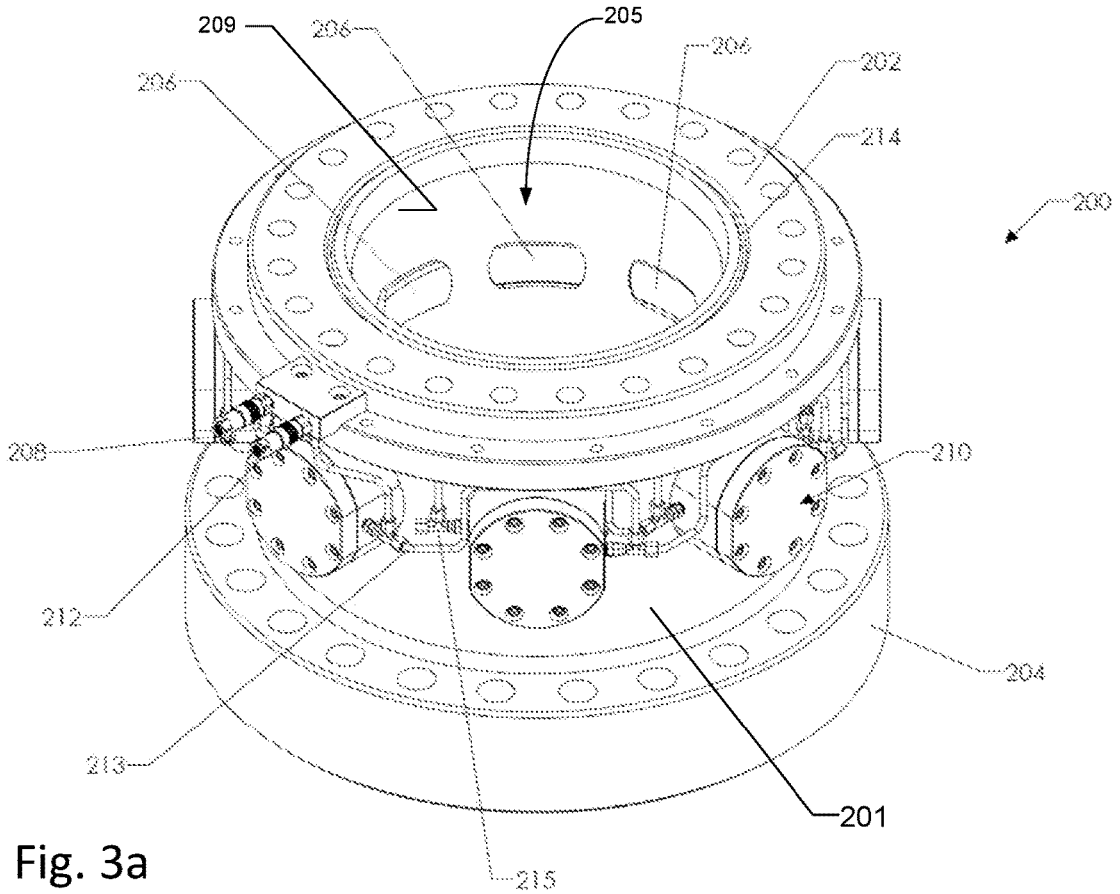
FIG. 3*a* is an isometric view of a multi-purpose latch in accordance with one aspect.
Figure 3B:
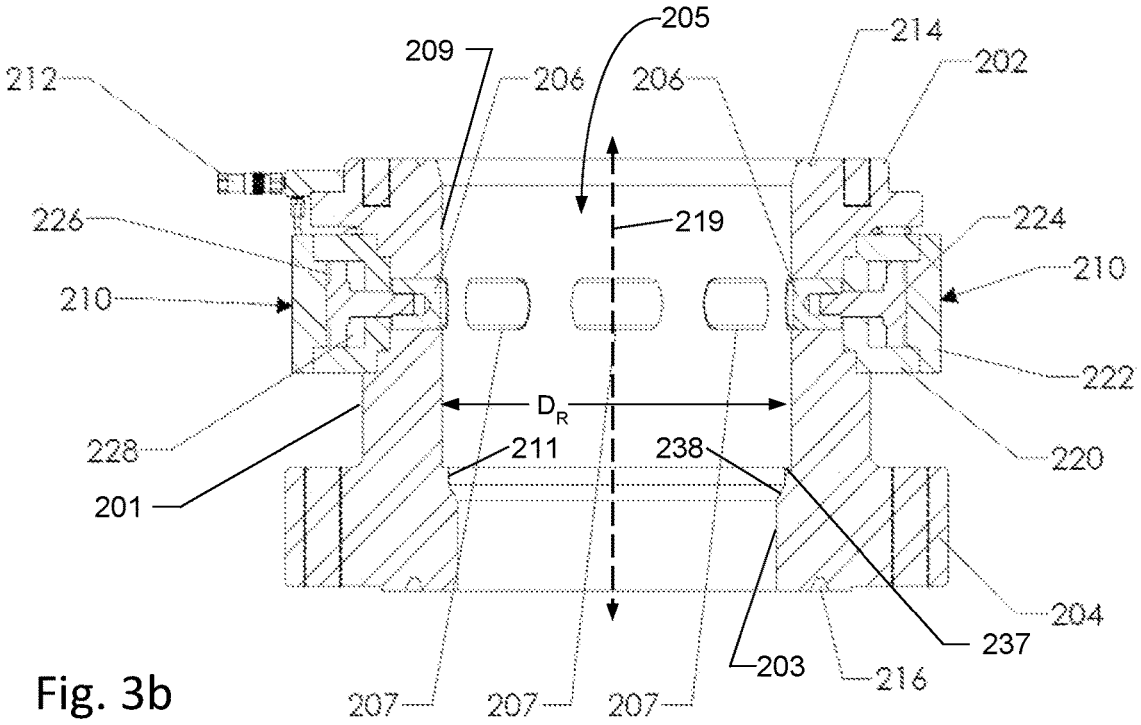
FIG. 3*b* is a cross section view of the multipurpose latch.

FIG. 3*a* is an isometric view of a multipurpose latch assembly (MPLA) 200 in accordance with one embodiment, and FIG. 3*b* is a cross section of same. The MPLA 200 includes an annular sidewall 201 extending between a top flange 202 and a bottom flange 204 along a vertical axis 219. The sidewall 201 has an interior bore surface 203 defining an interior bore 205. In some embodiments, the interior bore surface 203 will further define an upper receiving bore portion 209 having a relatively larger diameter (denoted $D_R$) separated by a shoulder 237 from a lower bore portion 211 having a relatively smaller diameter. In some embodiments, the interior bore surface 203 further defines a tapering portion 238 extending downward from the lower bore portion 211, the diameter of the tapering portion becoming smaller moving downward along the vertical axis 219 from the lower bore portion. Typically, as discussed earlier, the top of the annular BOP 12 on jack-up drilling rigs is an 18¾ inch 5000 or 10,000 psi flange shown as item 253*a* in FIG. 5. Still referring to FIG. 5 an adapter spool 250 can have a flange 253*b* with an 18¾ inch bore on the bottom and at the top can have a 21¼ inch 5000 psi flange 255. The adapter spool 250 can have one or more outlets/inlets 252, 254 as required by the drilling rig system for generic purposes. A key point here is that the adapter spool 250 can open up the bore of the flanges from 18¾ inches to 21¼ inches to provide the required bore 205 for the multipurpose latch assembly (MPLA) 200. Going back to FIGS. 3*a* and 3*b*, the bottom flange 204 of the MPLA 200 can be a 21¼ inch× 5000 psi API flange with a ring groove 216 that will take a BX-165 ring gasket as per specification API 6A. The top flange of the MPLA 200 can finish as a flange interface 202 with a ring gasket groove 214. This flange interface 202 can match the bottom of the bell nipple assembly 20 (FIG. 2) for a given rig. This will usually be a 20¾ inch 3000 psi or 21¼ inch 2000 psi flange, though in some instances there may be a more proprietary interface depending on the bell nipple assembly design.

Another key point is that the bore 205 of the MPLA 200 can be greater than the bore of the BOP system 15 (FIG. 2). This will enable a variety of tools to be installed like an isolation sleeve; a snubbing adapter; a logging adapter or any other required adapter. In some embodiments, the MPLA 200 can receive, in the receiving bore 209, a tool having a tool body diameter (denoted DT) that is greater than the BOP bore diameter (denoted $D_B$). The MPLA 200 can include latching dogs 206 that can be hydraulically pushed into the bore 205 through slots 207. The latching dogs 206 are actuated collectively with actuator assemblies 210. The latching dogs 206 can be designed to have a flush position with the receiving bore of the MPLA. In this context, the term "flush" means the interior faces of the latching dogs 206 provide an even, level surface with the interior sidewall surface 203, i.e., with the latching dogs neither protruding through the sidewall into the receiving bore 209 nor forming dents (i.e., cavities) in the walls of the receiving bore. In other words, in some embodiments of the MPLA 200, when the latching dogs 206 are in a retracted position, the radially inner ends (i.e., radially inner faces) of the latching dogs are configured to align flush with the inner surface of the sidewall defining the receiving bore 209. This can be further aided by shaping the latching dog faces concavely with the same radius as the inner bore of the MPLA. In other words, in some embodiments of the MPLA 200, the latching dogs 206 can be configured with interior faces (i.e., radially inner ends) having the same radius as the interior bore surface at the location of the latching slots 207.

Figure 3C:
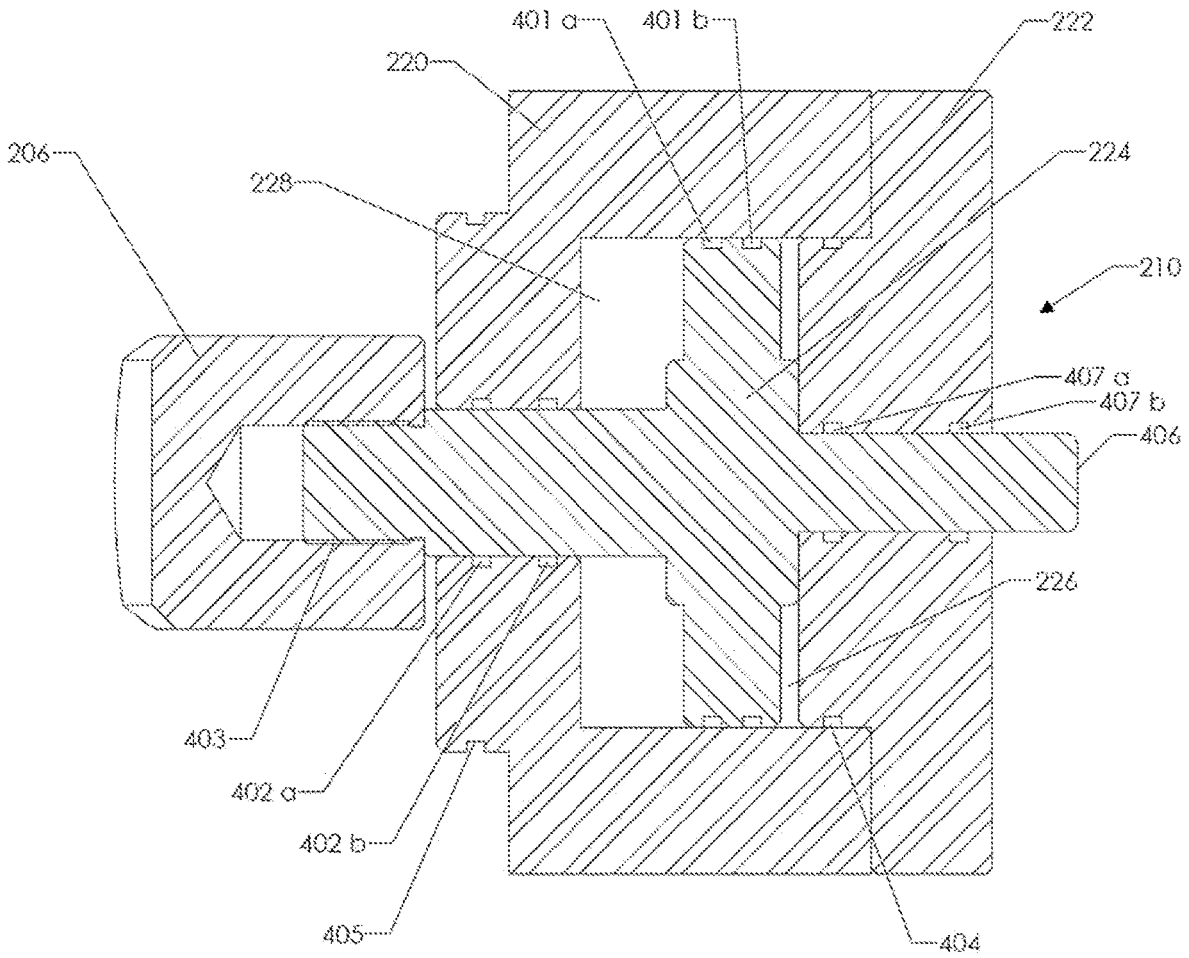
FIG. 3*c* is a cross section of the piston assembly.

Referring to FIG. 3*c* for details, each actuator assembly 210 has a piston 224 running inside a cylinder 220 that is pressure contained with a cap 222. The cap 222 seals the hydraulic cylinder assembly with seal 404. The piston 224 is connected to the dog 206 and isolated with seals 402*a* and 402*b*. A body seal 405 isolates the assembly from well bore pressure. Hydraulic fluid pressure acting on cavities 226 pushes the hydraulic piston 224 towards the bore in turn pushing the dogs 206 into the actual bore 205 of the MPLA 200 for latching. The piston 224 has double seals 401*a* and 401*b*. Application of hydraulic pressure to cavity 228 while bleeding pressure in cavity 226 reverses the process for unlatching. Hydraulic pressure through port 208 through liner system 215 actuates all pistons simultaneously for unlatching. Hydraulic pressure through port 212 through liner system 213 actuates all pistons simultaneously for latching. The piston has an indication pin 406 that is sealed to atmosphere with seals 407*a* and 407*b*.

Figure 4A:
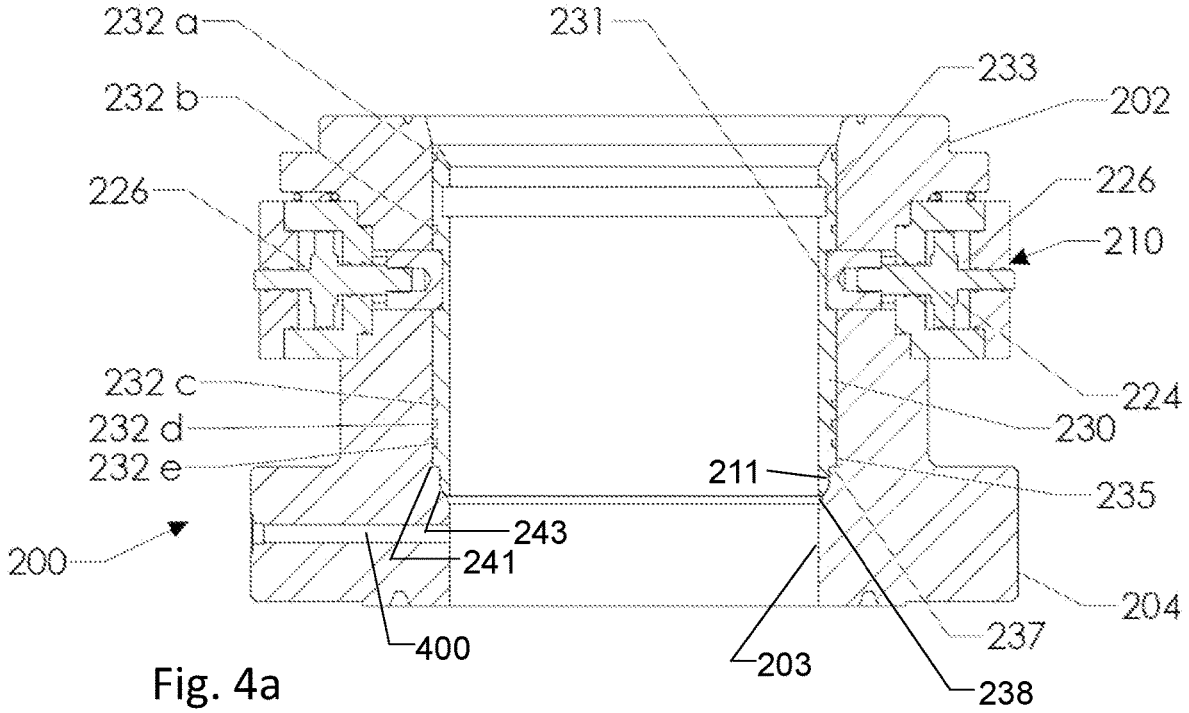
FIG. 4*a* is a cross section view of a multipurpose latch with an isolation sleeve installed in accordance with another aspect.
Figure 4B:
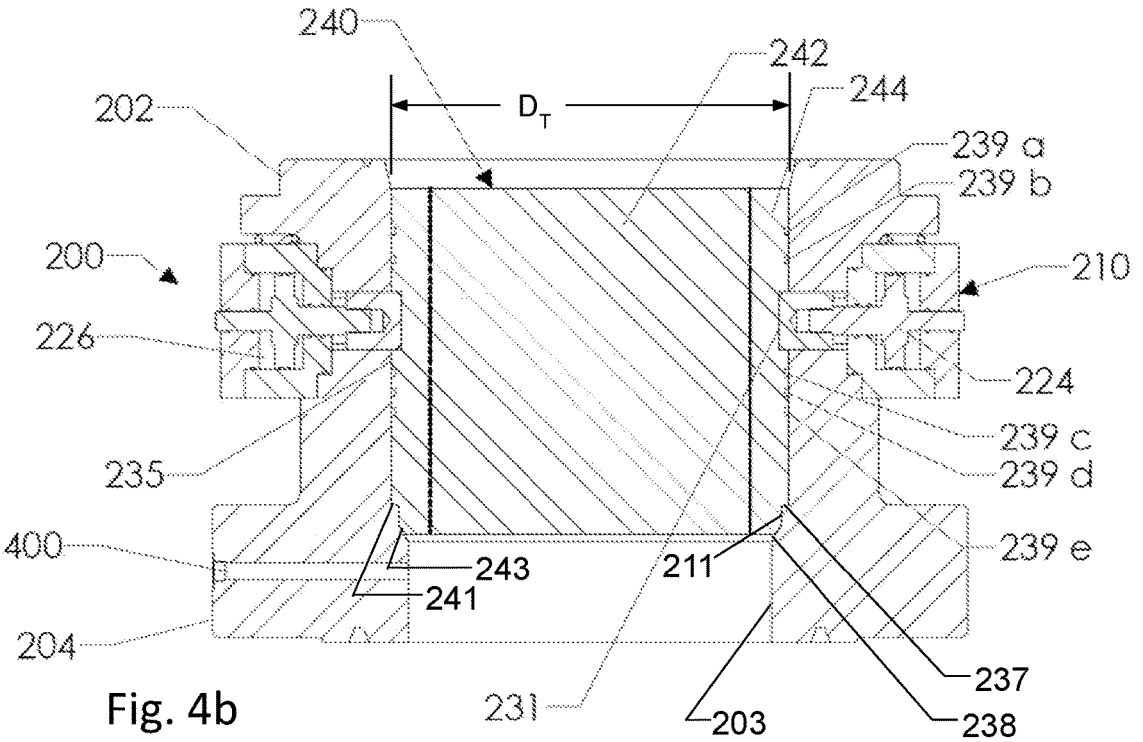
FIG. 4*b* is a cross section view of the multipurpose latch with an illustrative tool installed.

FIGS. 4*a* and 4*b* respectively show cross sections of an installed isolation sleeve (i.e., protective sleeve) 230 and schematically a schematic tool interface working tool assembly 240 (for illustration purposes). The FIGS. 4*a* and 4*b* also show the actuator assemblies 210 from FIG. 3*c* with the indication pins 406. Referring now to FIG. 4*a* we see the protective sleeve 230 is fully installed in the MPLA 200. All the latching dogs are fully engaged in a slot 231 running circumferentially on the exterior of the sleeve 230. The isolation sleeve 230 is shown fully landed on shoulder 237. In the illustrated embodiment, the isolation sleeve 230 includes a lower shoulder 241 that lands on the shoulder 237 of the MPLA 200 when the inset slot 231 of the isolation sleeve is aligned along the vertical axis 219 with the latching slots 207 of the MPLA. In the illustrated embodiment, the isolation sleeve 230 includes a lower taper 243 that engages the tapering portion 238 of the MPLA 200 when the inset slot 231 of the isolation sleeve is aligned along the vertical axis 219 with the latching slots 207 of the MPLA. The isolation sleeve 230 can have a circumferential interior slot 233 that can be used for locating a running/pulling tool. A typical J-slot system could also be used for this (not shown) purpose of installation/de-installation. The bore of the isolation sleeve 230 can be greater than 18¾ inches (BOP system 15 bore) but less than 21¼ inches (bore of bell nipple assembly 20). The isolation sleeve 230 will typically be installed if the drilling rig is not running pressurized operations. The isolation sleeve 230 acts as protector for the seal bore of the MPLA 200 when the system is not in use. In typical embodiments, the isolation sleeve 230 will have the same interior bore as the BOP 15 below. The isolation sleeve 230 has sealing rings 232*a* to 232*e* which may be a combination of excluder seals and sealing rings like O-rings. They seal on the seal bore 235 of the MPLA. The MPLA 200 is shown with a pressure port 400 that can measure pressure below the seal bore 235, so that a pressure transducer can be installed and provide a safety interlock for the hydraulic operation of the latch assemblies 210. This can be used to prevent any unlatching if there is pressure in the wellbore below any installed tool.

Referring to FIG. 4*b* we show schematically a working tool assembly 240. This will typically have an exterior cylindrical part 244 that will have the same external slot 231 as the isolation sleeve 230 for enabling latching with the dogs 206. The working tool 240 can also include a lower shoulder 241 that lands on the shoulder 237 of the MPLA 200 when the inset slot 231 of the working tool is aligned along the vertical axis 219 with the latching slots 207 of the MPLA. The working tool 240 can also include a lower taper 243 that engages the tapering portion 238 of the MPLA 200 when the inset slot 231 of the working tool is aligned along the vertical axis 219 with the latching slots 207 of the MPLA. The interior 242 of the tool can be anything that is required. The working tool assembly 240 will have sealing rings 239*a* to 239*e* that may be different in specification from the sealing rings 232*a* to 232*e* for the isolation sleeve 231.

Another key inventive feature for the MPLA design is the differing vertical positions of the sealing rings 232*a* to 232*e* located on the isolation sleeve 230, compared to the sealing rings 239*a* to 239*e* for the working tool 240. Typically, the isolation sleeve 230 may be installed for long periods of time. This may lead to deterioration of the sealing faces due to corrosion of the seal bore 235 in the regions directly opposite to the positions of the sealing rings 232*a* to 232*e*. The seal ring positions of seals 232*a* and 232*e* are respectively at the upper and lower vertical extremities of the isolation sleeve 230. This ensures that the seal bore 235 is kept free from wellbore fluids when the isolation sleeve is installed. This is a common failure: the deterioration of the seal bore 230 by corrosion at the location of the seals, especially the uppermost and lowermost seals respectively 232*a* and 232*e* which are isolation to the fluids in the bore.

Figure 5:
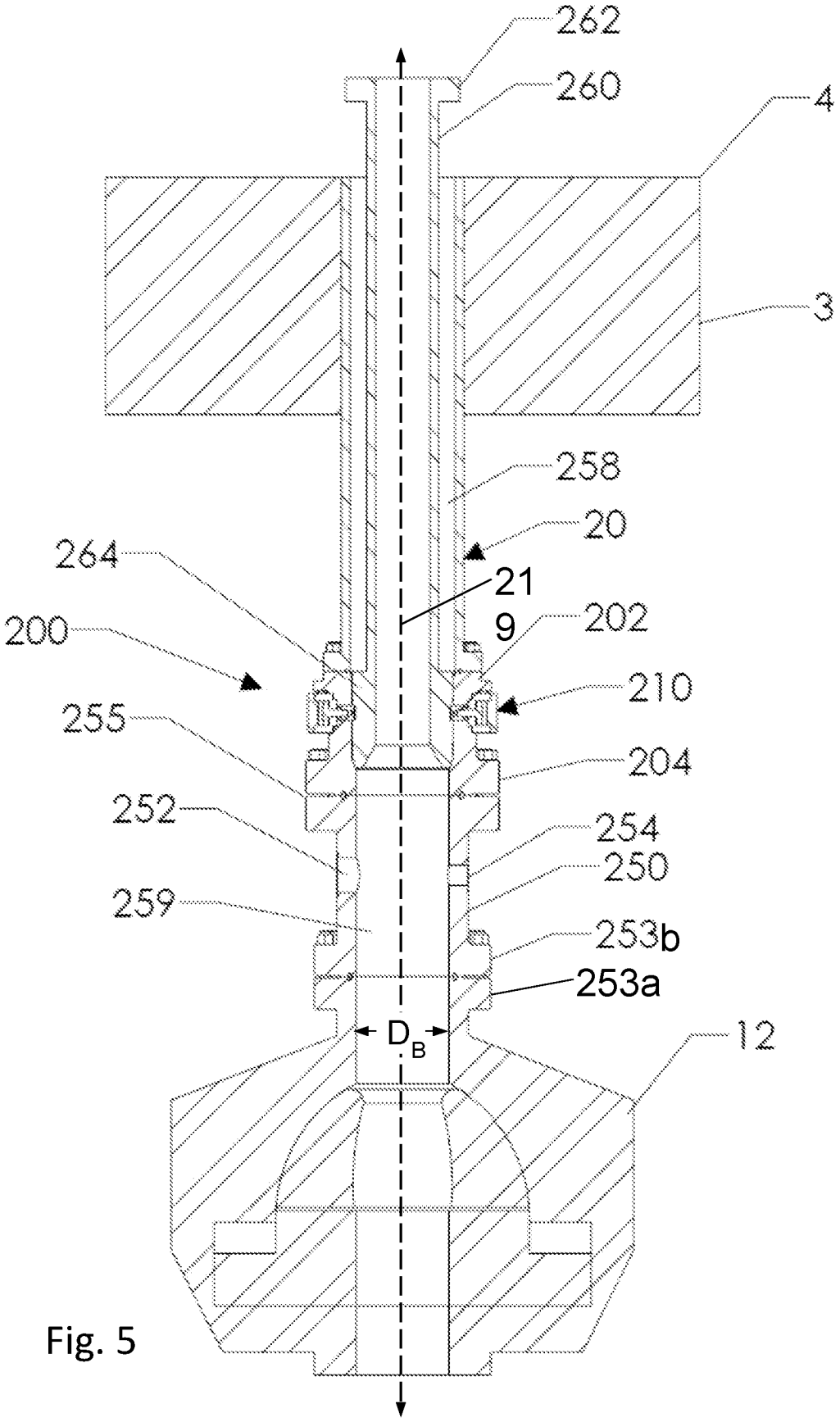
FIG. 5 is a cross section view of a multipurpose latch with an installed snubbing or coiled tubing adapter.
Figure 6:
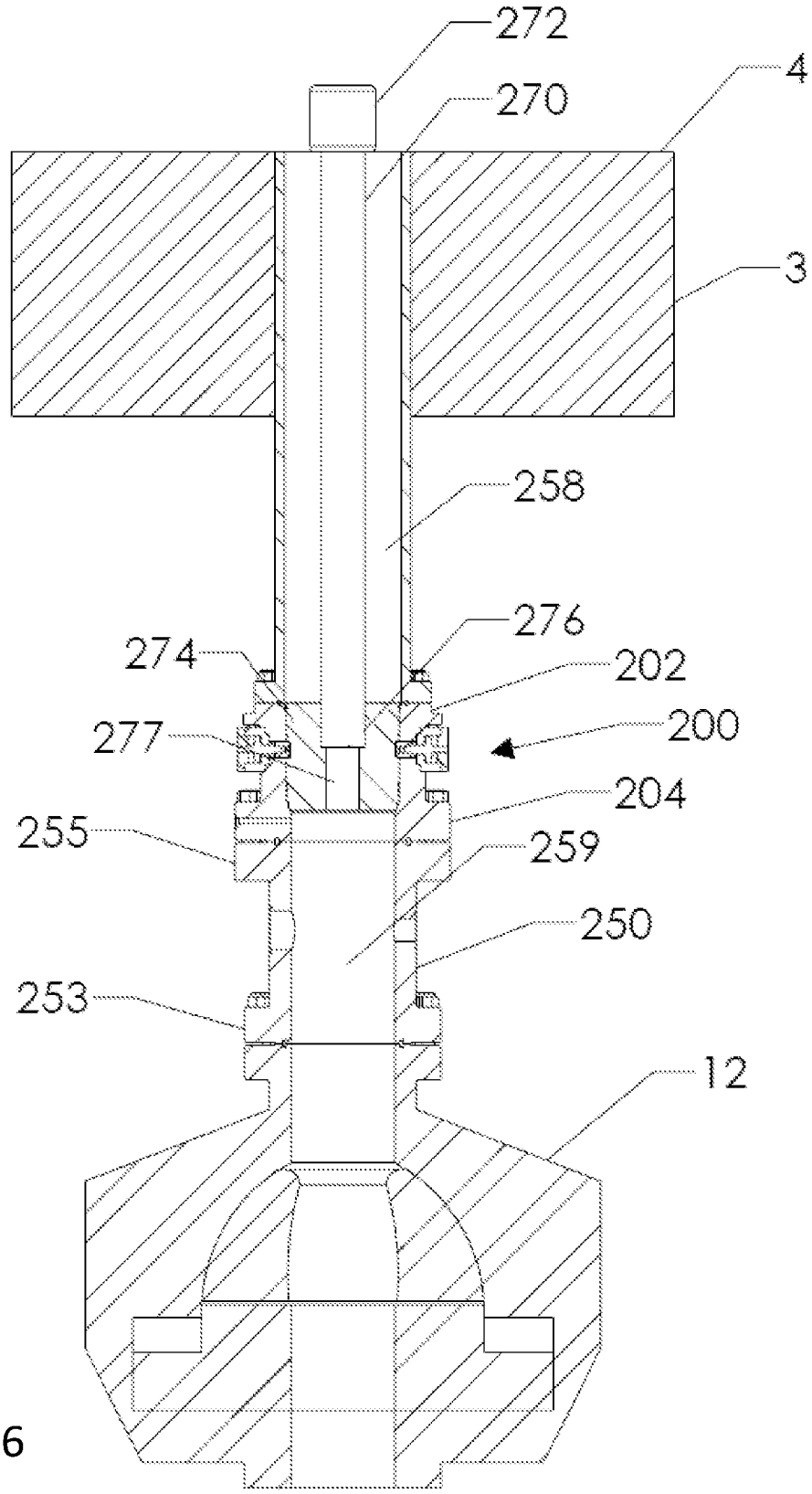
FIG. 6 is a cross section view of a multipurpose latch with an installed logging adapter.
Figure 7:
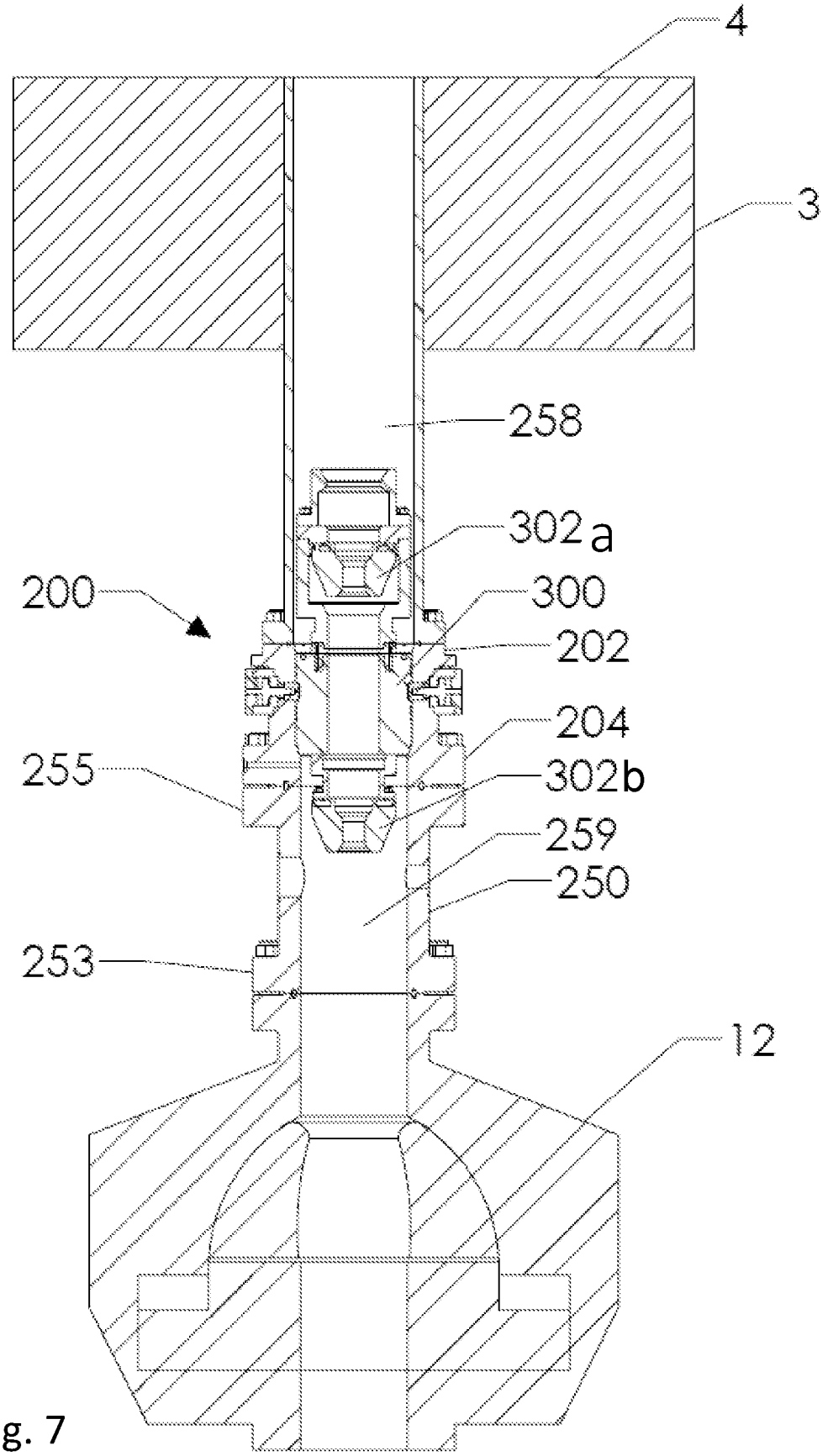
FIG. 7 is a cross section view of a multipurpose latch with an installed bearing assembly.

FIGS. 5 to 7 show different embodiments of the working tool 240. Each of the embodiments: coiled tubing adapter 264, logging adapter 274 and bearing assembly adapter 300 have an external profile that is the same as the exterior cylindrical part 244 from FIG. 4*b*. By placing the sealing rings 239*a* to 239*e* for the working tools (264, 274 and 300) in differing vertical positions a clean seal bore can be offered for working applications. This is another key inventive feature of the system to guarantee sealing performance after long periods of non-pressurized use. It means that none of the seal positions between the isolation sleeve 230 and working tools overlap and ALL of the working tool seals are BETWEEN the upper isolation sleeve seal 232*a* and the lower isolation sleeve seal 232*e*.

FIG. 5 shows a cross section of an MPLA 200 used for creating pressure isolation intended for a snubbing or coiled tubing operation under pressure. Shown going from top to bottom is a rig floor 4 on top of the substructure 3. A bell nipple assembly 20 is connected to the top of the MPLA 200 and below that is an adapter spool 250. The adapter spool 250 is bolted to the top of the annular BOP 12. The standard practice for creating such a rig-up was by installing a high-pressure pipe from just above the rig floor 4 to below the annular BOP 12. At the bottom of the pipe would be a substantial retaining ring or flange. The annular BOP 12 would be closed, the pressure seal effected by the annular and the retaining ring would prevent the ejection of this old type snubbing adapter (not shown) under pressure. Many jobs have been done like this but it is not a good solution especially as the use of the annular BOP 12 is lost for any emergencies. The adapter spool 250 will typically have at least one outlet 252 and one inlet 254, but there may be several of these as required.

Referring still to FIG. 5, in this refined version an integral (welded) snubbing adapter 260 is installed with a pressure connection 262 which is typically a flange that is just above the rig floor 3. At the bottom of the snubbing adapter 260 is a coiled tubing adapter 264 having a tool interface much as was described in FIG. 4*b*. This can be latched and pressure isolated with the MPLA 200 as shown. Now the higher pressure rated cavity 259 that can hold pressure up to the rating of the annular BOP 12 is isolated from the lower pressure cavity 258. A much safer and more elegant embodiment of the invention. Note that typically for snubbing or coiled tubing operations under pressure there is a requirement to return fluids that are coming from cavity 259. Thus, the MPLA 200 can be used with adapter spool 250 with outlet 252 and inlet 254 configured as desired.

Referring now to FIG. 6 there is shown a similar rig-up for installation of a wireline lubricator. A logging adapter 274 having a tool interface with externals as explained for FIG. 4*b* is installed in the MPLA 200. This logging adapter 274 has a bore 277 with a tubing thread 276 into which a tubing 270 is screwed (before installation). At the top of the tubing 270 is a tubing joint 272 into which the cross over carried by the slickline or wireline service company can be screwed. In this way a safe and easily installed conversion is created for being able to log or wireline under pressure is established, again isolating high pressure cavity 259 from the lower pressure cavity 258. The actual configuration of parts 279, 272 and 274 may differ based on the actual service company requirements. What remains the same is the external interface between part 274 and the MPLA 200. Note that typically for logging operations under pressure there is the possibility to bleed through the surface assembly attached to the tubing joint 272 and an adapter spool may or may not be installed. Thus, the MPLA 200 can be used WITHOUT an adapter spool 250.

Referring now to FIG. 7 there is shown a rotating control bearing assembly 300 installed in the MPLA 200. The assembly shown has two stripper elements 302*a* and 302*b*. The bore 205 of the MPLA 200 as mentioned earlier can be much larger than the typical 18¾ inch bore of the BOP system 15. This means that it will be easy to adapt all third party rotating control device designs to interface with the MPLA 200, with the service company just having to create an adapter for the latch profile. For this assembly an adapter spool 250 is required as the seals 302*a* and 302*b* isolate the drilling string (not shown) passing through them, thus requiring the return of drilling fluid.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the scope of the invention.

What is claimed is:

1. A multipurpose latch assembly (MPLA) for a drilling rig having a blow out preventer (BOP), wherein the BOP includes a housing defining a vertical bore extending through the housing along a vertical axis, the vertical bore having a BOP bore diameter, the MPLA comprising:

a body including:

an upper flange having an upper flange configuration;

a lower flange having a lower flange configuration; and an annular sidewall extending between the upper flange and the lower flange about the vertical axis, an inner surface of the sidewall defining a receiving bore formed about the vertical axis, the receiving bore having a diameter;

the sidewall further defining a plurality of latching slots extending radially outward, relative to the vertical axis, from the receiving bore into the sidewall;

a plurality of actuator assemblies attached to an outer surface of the sidewall, each respective actuator assembly being disposed adjacent a respective latching slot, and each actuator assembly including:

a cylinder having a cylinder bore;

a piston slidably mounted in the cylinder bore to define a latch cavity disposed on a first side of the piston and an unlatch cavity disposed on a second side of the piston, wherein selectively adding fluid into the latch cavity causes the piston to move in a first direction and selectively adding fluid into the unlatch cavity causes the piston to move in a second direction;

a plurality of latching dogs, each respective latching dog being slidably mounted in a respective latching slot for moving between an unlatched position, wherein a radially inner end of the respective latching dog is disposed within the respective latching slot and does not extend radially into the receiving bore, and a latched position, wherein the radially inner end of the respective latching dog extends radially inward from the respective latching slot at least partially into the receiving bore, and;

wherein each respective latching dog is operatively mechanically connected to a respective piston so that moving the respective piston in the first direction causes the respective latching dog to move toward the latched position and moving the respective piston in the second direction causes the respective latching dog to move toward the unlatched position; and wherein the MPLA is adapted to receive, in the receiving bore, a tool having a circumferential sidewall with a circumferential inset slot formed in a radially outer surface thereof, the circumferential sidewall having a tool body diameter and the circumferential inset slot having a slot depth below the radially outer surface of the circumferential sidewall, wherein the receiving bore diameter of the MPLA is selected so that, when the latching dogs are in the unlatched position, the tool is insertable into the receiving bore of the MPLA such that the circumferential inset slot of the tool is axially aligned with the latching slots of the MPLA, and when the latching dogs are in the latched position, the tool is not insertable into the receiving bore of the MPLA such that the circumferential inset slot is axially aligned with the latching slots; and wherein, when the tool is inserted into the receiving bore of the MPLA such that the circumferential inset slot of the tool is axially aligned with the latching slots of the MPLA and the latching dogs are in the latched position, the radially inner ends of the latching dogs extend into the circumferential inset slot to prevent withdrawal of the tool from the receiving bore; and wherein the inner surface of the annular sidewall further defines a mounting shoulder disposed at a lower end of the receiving bore, the mounting shoulder comprising at least one shoulder profile having a shoulder diameter that is less than a receiving bore diameter, the shoulder profile having an axial position, relative to the latching slots, to stop insertion of the tool into the receiving bore when the circumferential inset slot of the tool is axially aligned with the latching slots of the MPLA.

2. The MPLA in accordance with claim 1, wherein the receiving bore diameter of the MPLA is greater than the BOP bore diameter; and wherein the MPLA is adapted to receive, in the receiving bore, a tool having a tool body diameter that is greater that the BOP bore diameter.

3. The MPLA in accordance with claim 1, wherein the radially inner ends of the latching dogs are shaped concavely with the same radius as the inner surface of the sidewall defining the receiving bore; and wherein when the latching dogs are fully retracted, the radially inner ends of the latching dogs are flush with the sidewall bore.

4. The MPLA in accordance with claim 1 adapted to receive a tool in the receiving bore, wherein the tool is an adapter for a snubbing tool, and wherein the tool has a first seal between the tool and the receiving bore disposed at a first axial position along the vertical axis and a second seal between the tool and the receiving bore disposed at a second axial position along the vertical axis.

5. The MPLA in accordance with claim 1 adapted to receive a tool in the receiving bore, wherein the tool is a coil tubing adapter, and wherein the tool has a first seal between the tool and the receiving bore disposed at a first axial position along the vertical axis and a second seal between the tool and the receiving bore disposed at a second axial position along the vertical axis.

6. The MPLA in accordance with claim 1 adapted to receive a tool in the receiving bore, wherein the tool is a logging adapter, and wherein the tool has a first seal between the tool and the receiving bore disposed at a first axial position along the vertical axis and a second seal between the tool and the receiving bore disposed at a second axial position along the vertical axis.

7. The MPLA in accordance with claim 1 adapted to receive a tool in the receiving bore, wherein the tool is an adapter for a rotating control device (RCD) bearing assembly, and wherein the tool has a first seal between the tool and the receiving bore disposed at a first axial position along the vertical axis and a second seal between the tool and the receiving bore disposed at a second axial position along the vertical axis.

8. The MPLA in accordance with claim 1, wherein the actuator assemblies are hydraulic actuators.

9. The MPLA in accordance with claim 1, wherein the actuator assemblies are electric actuators.

10. The MPLA in accordance with claim 1, where the upper flange configuration is one of:

a 20¾ inch×3000 psi flange according to API 6A; or a 21¼ inch×2000 psi flange according to API 6A.

11. The MPLA in accordance with claim 1, where the lower flange configuration is a 21¼ inch×5000 psi flange according to API 6A.

12. The MPLA in accordance with claim 1, further comprising an adapter spool for attachment between the MPLA body and the BOP, the adapter spool comprising:

an upper spool flange having an upper spool flange configuration adapted for attachment to the lower flange of the MPLA;

a lower spool flange having a lower spool flange configuration adapted for attachment to an upper flange of the BOP; and an annular spool sidewall extending between the upper spool flange and the lower spool flange about the vertical axis, wherein a length of the annular spool sidewall is selected to provide a desired overall MPLA length, measured between the upper flange of the MPLA body and the lower spool flange of the adapter spool, equal to a length of a pre-existing riser component to be removed for installation of a selected tool.

13. The MPLA in accordance with claim 12, where the upper spool flange configuration is a 21¼ inch×5000 psi flange according to API 6A.

14. The MPLA in accordance with claim 12, where the lower flange configuration is a 18¾ inch×5000 psi flange according to API 6A.

15. The MPLA in accordance with claim 1, wherein the inner surface of the annular sidewall further defines:

a lower bore portion extending downward from a radially inward edge of the shoulder profile; and a tapering portion extending downward from a lower edge of the lower bore portion, the tapering portion having a diameter becoming smaller moving downward from the lower bore portion.

16. The MPLA in accordance with claim 15, wherein the tapering portion has a second axial position, relative to the latching slots, configured to engage the tool when the circumferential inset slot of the tool is axially aligned with the latching slots of the MPLA.

17. A multipurpose latch assembly (MPLA) for a drilling rig having a blow out preventer (BOP), wherein the BOP includes a housing defining a vertical bore extending through the housing along a vertical axis, the vertical bore having a BOP bore diameter, the MPLA comprising:

a body including:

an upper flange having an upper flange configuration;

a lower flange having a lower flange configuration; and an annular sidewall extending between the upper flange and the lower flange about the vertical axis, an inner surface of the sidewall defining a receiving bore formed about the vertical axis, the receiving bore having a diameter;

the sidewall further defining a plurality of latching slots extending radially outward, relative to the vertical axis, from the receiving bore into the sidewall;

a plurality of actuator assemblies attached to an outer surface of the sidewall, each respective actuator assembly being disposed adjacent a respective latching slot, and each actuator assembly including:

a cylinder having a cylinder bore;

a piston slidably mounted in the cylinder bore to define a latch cavity disposed on a first side of the piston and an unlatch cavity disposed on a second side of the piston, wherein selectively adding fluid into the latch cavity causes the piston to move in a first direction and selectively adding fluid into the unlatch cavity causes the piston to move in a second direction;

a plurality of latching dogs, each respective latching dog being slidably mounted in a respective latching slot for moving between an unlatched position, wherein a radially inner end of the respective latching dog is disposed within the respective latching slot and does not extend radially into the receiving bore, and a latched position, wherein the radially inner end of the respective latching dog extends radially inward from the respective latching slot at least partially into the receiving bore, and;

wherein each respective latching dog is operatively mechanically connected to a respective piston so that moving the respective piston in the first direction causes the respective latching dog to move toward the latched position and moving the respective piston in the second direction causes the respective latching dog to move toward the unlatched position; and wherein the MPLA is adapted to receive, in the receiving bore, a tool having a circumferential sidewall with a circumferential inset slot formed in a radially outer surface thereof, the circumferential sidewall having a tool body diameter and the circumferential inset slot having a slot depth below the radially outer surface of the circumferential sidewall, wherein the receiving bore diameter of the MPLA is selected so that, when the latching dogs are in the unlatched position, the tool is insertable into the receiving bore of the MPLA such that the circumferential inset slot of the tool is axially aligned with the latching slots of the MPLA, and when the latching dogs are in the latched position, the tool is not insertable into the receiving bore of the MPLA such that the circumferential inset slot is axially aligned with the latching slots; and wherein, when the tool is inserted into the receiving bore of the MPLA such that the circumferential inset slot of the tool is axially aligned with the latching slots of the MPLA and the latching dogs are in the latched position, the radially inner ends of the latching dogs extend into the circumferential inset slot to prevent withdrawal of the tool from the receiving bore; and wherein each actuator assembly further comprises a piston shaft extending from the piston to the latching dog through a radially inner wall of the cylinder to operatively mechanically connect the piston to the latching dog; and wherein each actuator assembly further comprises an indication pin extending from the piston through a radially outer wall of the cylinder to an exterior of the MPLA to provide an external visual indication of the position of the piston and the attached latching dog.

18. A multipurpose latch assembly (MPLA) for a drilling rig having a blow out preventer (BOP), wherein the BOP includes a housing defining a vertical bore extending through the housing along a vertical axis, the vertical bore having a BOP bore diameter, the MPLA comprising:

a body including:

an upper flange having an upper flange configuration;

a lower flange having a lower flange configuration; and an annular sidewall extending between the upper flange and the lower flange about the vertical axis, an inner surface of the sidewall defining a receiving bore formed about the vertical axis, the receiving bore having a diameter;

the sidewall further defining a plurality of latching slots extending radially outward, relative to the vertical axis, from the receiving bore into the sidewall;

a plurality of actuator assemblies attached to an outer surface of the sidewall, each respective actuator assembly being disposed adjacent a respective latching slot, and each actuator assembly including:

a cylinder having a cylinder bore;

a piston slidably mounted in the cylinder bore to define a latch cavity disposed on a first side of the piston and an unlatch cavity disposed on a second side of the piston, wherein selectively adding fluid into the latch cavity causes the piston to move in a first direction and selectively adding fluid into the unlatch cavity causes the piston to move in a second direction;

a plurality of latching dogs, each respective latching dog being slidably mounted in a respective latching slot for moving between an unlatched position, wherein a radially inner end of the respective latching dog is disposed within the respective latching slot and does not extend radially into the receiving bore, and a latched position, wherein the radially inner end of the respective latching dog extends radially inward from the respective latching slot at least partially into the receiving bore, and;

wherein each respective latching dog is operatively mechanically connected to a respective piston so that moving the respective piston in the first direction causes the respective latching dog to move toward the latched position and moving the respective piston in the second direction causes the respective latching dog to move toward the unlatched position; and wherein the MPLA is adapted to receive, in the receiving bore, a tool having a circumferential sidewall with a circumferential inset slot formed in a radially outer surface thereof, the circumferential sidewall having a tool body diameter and the circumferential inset slot having a slot depth below the radially outer surface of the circumferential sidewall, wherein the receiving bore diameter of the MPLA is selected so that, when the latching dogs are in the unlatched position, the tool is insertable into the receiving bore of the MPLA such that the circumferential inset slot of the tool is axially aligned with the latching slots of the MPLA, and when the latching dogs are in the latched position, the tool is not insertable into the receiving bore of the MPLA such that the circumferential inset slot is axially aligned with the latching slots; and wherein, when the tool is inserted into the receiving bore of the MPLA such that the circumferential inset slot of the tool is axially aligned with the latching slots of the MPLA and the latching dogs are in the latched position, the radially inner ends of the latching dogs extend into the circumferential inset slot to prevent withdrawal of the tool from the receiving bore; and wherein the MPLA is adapted to receive an isolation sleeve in the receiving bore when a tool is not present in the receiving bore, the tool that is not present in the receiving bore having a first tool seal between the tool and the receiving bore disposed at a first axial position along the vertical axis and a second tool seal between the tool and the receiving bore disposed at a second axial position, the isolation sleeve having a first sleeve seal between the isolation sleeve and the receiving bore disposed at a third axial position along the vertical axis, the third axial position being different from both the first and second axial positions, and a second sleeve seal between the isolation sleeve and the receiving bore disposed at a fourth axial position along the vertical axis, the fourth axial position being different from both the first and second axial positions.

19. The MPLA in accordance with claim 18, wherein the isolation sleeve that the receiving bore is adapted to receive has an inner bore that is equal in diameter to the vertical bore of the BOP below.

20. The MPLA in accordance with claim 18, wherein the isolation sleeve that the receiving bore is adapted to receive has vertical O-ring positions in different vertical locations from the O-ring position of the tool that is not present in the receiving bore.

* * * * *